US009390717B2

(12) United States Patent
Yamamoto et al.

(10) Patent No.: US 9,390,717 B2
(45) Date of Patent: Jul. 12, 2016

(54) ENCODING DEVICE AND METHOD, DECODING DEVICE AND METHOD, AND PROGRAM

(75) Inventors: Yuki Yamamoto, Tokyo (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 25 days.

(21) Appl. No.: 14/237,933

(22) PCT Filed: Aug. 14, 2012

(86) PCT No.: PCT/JP2012/070682

§ 371 (c)(1),
(2), (4) Date: Feb. 10, 2014

(87) PCT Pub. No.: WO2013/027629

PCT Pub. Date: Feb. 28, 2013

(65) Prior Publication Data

US 2014/0205101 A1 Jul. 24, 2014

(30) Foreign Application Priority Data

Aug. 24, 2011 (JP) ..... 2011-182448

(51) Int. Cl.
*G10L 19/008* (2013.01)
*G10L 19/02* (2013.01)
(Continued)

(52) U.S. Cl.
CPC ..... *G10L 19/008* (2013.01); *G10L 19/0208* (2013.01); *G10L 19/22* (2013.01); *G10L 21/038* (2013.01)

(58) Field of Classification Search
USPC ..... 381/22, 23; 704/500, 501, 502, E21.011
See application file for complete search history.

(56) References Cited

U.S. PATENT DOCUMENTS 7,246,065 B2 * 7/2007 Tanaka ..... H04N 19/61 375/E7.092
8,364,474 B2 1/2013 Honma et al.
(Continued)

FOREIGN PATENT DOCUMENTS

EP 1921610 A2 5/2008
EP 2019391 A2 1/2009
(Continued)

OTHER PUBLICATIONS

Chennoukh et al., Speech enhancement via frequency bandwidth extension using line spectral frequencies. IEEE International Conference on Acoustics, Speech and Signal Processing., 2001;1:665-668.
(Continued)

*Primary Examiner* — Brenda Bernardi
(74) *Attorney, Agent, or Firm* — Wolf, Greenfield & Sacks, P.C.

(57) ABSTRACT

The present technology relates to an encoding device and method, a decoding device and method, and a program that enable audio of a high audio quality to be obtained with a smaller code amount.

The encoding device multiplexes low frequency encoding data obtained by encoding a low frequency component of an input signal and high frequency encoding data obtained by encoding data including an estimation coefficient to acquire a high frequency component of the input signal by estimation and outputs multiplexed data. When the input signal is encoded, a calculation unit calculates pseudo high frequency subband power to be an estimation value of power of the high frequency component from an estimation coefficient selected in a frame immediately before a frame of a processing target and the high frequency component of the input signal. In addition, a determination unit determines whether reuse of the estimation coefficient of the immediately previous frame is enabled in the frame of the processing target, on the basis of a comparison result of the calculated pseudo high frequency subband power and actual high frequency component power. The present invention can be applied to the encoding device.

19 Claims, 9 Drawing Sheets

(51) Int. Cl.
*G10L 19/22* (2013.01)
*G10L 21/038* (2013.01)

(56) References Cited

U.S. PATENT DOCUMENTS

| | | | | |
|---|---|---|---|---|
| 8,949,119 | B2 | 2/2015 | Yamamoto et al. | |
| 9,177,563 | B2 | 11/2015 | Yamamoto et al. | |
| 9,208,795 | B2 | 12/2015 | Yamamoto et al. | |
| 2003/0093271 | A1 | 5/2003 | Tsushima et al. | |
| 2003/0187663 | A1 | 10/2003 | Truman et al. | |
| 2005/0060146 | A1 | 3/2005 | Oh | |
| 2005/0143985 | A1 | 6/2005 | Sung et al. | |
| 2005/0267763 | A1 | 12/2005 | Ojanpera | |
| 2006/0031075 | A1 | 2/2006 | Oh et al. | |
| 2007/0005351 | A1 | 1/2007 | Sathyendra et al. | |
| 2007/0088541 | A1* | 4/2007 | Vos | G10L 19/0208 704/219 |
| 2007/0150267 | A1 | 6/2007 | Honma et al. | |
| 2007/0174063 | A1 | 7/2007 | Mehrotra et al. | |
| 2007/0219785 | A1 | 9/2007 | Gao | |
| 2007/0299656 | A1* | 12/2007 | Son | G10L 21/038 704/205 |
| 2008/0129350 | A1 | 6/2008 | Mitsufuji et al. | |
| 2008/0140425 | A1 | 6/2008 | Shimada | |
| 2009/0271204 | A1* | 10/2009 | Tammi | G10L 19/0208 704/500 |
| 2010/0063802 | A1 | 3/2010 | Gao | |
| 2010/0217607 | A1 | 8/2010 | Neuendorf et al. | |
| 2010/0222907 | A1 | 9/2010 | Hashimoto | |
| 2011/0137650 | A1 | 6/2011 | Ljolje | |
| 2011/0137659 | A1 | 6/2011 | Honma et al. | |
| 2012/0016668 | A1 | 1/2012 | Gao | |
| 2012/0243526 | A1 | 9/2012 | Yamamoto et al. | |
| 2013/0028427 | A1 | 1/2013 | Yamamoto et al. | |
| 2013/0030818 | A1 | 1/2013 | Yamamoto et al. | |
| 2013/0124214 | A1 | 5/2013 | Yamamoto et al. | |
| 2013/0202118 | A1 | 8/2013 | Yamamoto et al. | |
| 2013/0208902 | A1 | 8/2013 | Yamamoto et al. | |
| 2014/0006037 | A1 | 1/2014 | Honma et al. | |
| 2014/0172433 | A2 | 6/2014 | Honma et al. | |
| 2014/0200899 | A1 | 7/2014 | Yamamoto et al. | |
| 2014/0200900 | A1 | 7/2014 | Yamamoto et al. | |
| 2015/0120307 | A1 | 4/2015 | Yamamoto et al. | |
| 2016/0012829 | A1 | 1/2016 | Yamamoto et al. | |
| 2016/0019911 | A1 | 1/2016 | Yamamoto et al. | |

FOREIGN PATENT DOCUMENTS

| | | | |
|---|---|---|---|
| EP | 2317509 | A1 | 5/2011 |
| EP | 2472512 | A1 | 7/2012 |
| JP | 3-254223 | | 11/1991 |
| JP | 10-020888 | A | 1/1998 |
| JP | 2003-216190 | A | 7/2003 |
| JP | 2003-255973 | A | 9/2003 |
| JP | 2004-101720 | A | 4/2004 |
| JP | 2004-258603 | A | 9/2004 |
| JP | 2005-521907 | A | 7/2005 |
| JP | 2006-048043 | A | 2/2006 |
| JP | 2007-171821 | A | 7/2007 |
| JP | 2008-139844 | | 6/2008 |
| JP | 2008-139844 | A | 6/2008 |
| JP | 2009-116371 | | 5/2009 |
| JP | 2010-020251 | | 1/2010 |
| JP | 2010-079275 | | 4/2010 |
| KR | 10-2007-0083997 | A | 8/2007 |
| KR | 10-2007-0118174 | A | 12/2007 |
| WO | WO 2006/049205 | | 5/2006 |
| WO | WO 2007/052088 | A1 | 5/2007 |
| WO | WO 2007/126015 | A1 | 11/2007 |
| WO | WO 2009/054393 | A | 4/2009 |
| WO | WO 2009/093466 | A1 | 7/2009 |
| WO | WO 2010/024371 | A1 | 3/2010 |
| WO | WO 2011/043227 | | 4/2011 |

OTHER PUBLICATIONS

Liu et al., High frequency reconstruction for band-limited audio signals. Proc of the 6th Int'l Conference on Digital Audio Effects, DAX 1-6, London, UK. Sep. 8-11, 2003, 6 pages.

* cited by examiner

ENCODING DEVICE AND METHOD, DECODING DEVICE AND METHOD, AND PROGRAM

TECHNICAL FIELD

The present technology relates to an encoding device and method, a decoding device and method, and a program and more particularly, to an encoding device and method, a decoding device and method, and a program that enable audio of a high audio quality to be obtained with a smaller code amount.

BACKGROUND ART

In the related art, HE-AAC (High Efficiency MPEG (Moving Picture Experts Group) 4 AAC (Advanced Audio Coding)) (International Standard ISO/IEC14496-3) or AAC (MPEG2 AAC) (International Standard ISO/IEC13818-7) has been known as a method of encoding an audio signal.

For example, a method of outputting low frequency encoding information obtained by encoding a low frequency component and high frequency encoding information generated from a low frequency component and a high frequency component and used to obtain an estimation value of the high frequency component as codes obtained by encoding has been suggested as the method of encoding an audio signal (for example, refer to Patent Document 1). According to this method, information necessary to calculate the estimation value of the high frequency component, such as a scale factor to obtain a frequency component of a high frequency, an amplitude adjustment coefficient, and a spectrum residual error, is included in the high frequency encoding information.

In addition, when decoding is performed, the high frequency component is estimated on the basis of the low frequency component obtained by decoding the low frequency encoding information and information obtained by decoding the high frequency encoding information and the high frequency component obtained by the estimation and the low frequency component obtained by the decoding are synthesized and become an audio signal obtained by the decoding.

In this encoding method, because only the information to obtain the estimation value of the high frequency component is encoded as information regarding a signal component of a high frequency, encoding efficiency can be improved while an audio quality is suppressed from being deteriorated.

CITATION LIST

Patent Documents

Patent Document 1: WO 2006/049205 A

SUMMARY OF THE INVENTION

Problems to be Solved by the Invention

In the related art, the audio of the high audio quality can be obtained when the decoding is performed. However, because it is necessary to generate the information to calculate the estimation value of the high frequency component in a processing unit of the audio signal, a code amount of the high frequency encoding information is not sufficiently small.

The present technology has been made in view of the above circumstances and enables audio of a high audio quality to be obtained with a smaller code amount.

Solutions to Problems

An encoding device according to a first aspect of the present technology includes a subband division unit that performs band division of an input signal and generates high frequency subband signals of subbands of a high frequency side of the input signal, a calculation unit that calculates pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance, a generation unit that, when reuse of the estimation coefficient of the immediately previous frame is enabled in the frame of the processing target, on the basis of the pseudo high frequency subband power and the high frequency subband power obtained from the high frequency subband signal, generates data to obtain the reuse enabled estimation coefficient, a low frequency encoding unit that encodes the low frequency signal and generates low frequency encoding data, and a multiplexing unit that multiplexes the data and the low frequency encoding data and generates an output code string.

In the encoding device, a pseudo high frequency subband power calculation unit that calculates the pseudo high frequency subband power on the basis of the feature amount and the estimation coefficients, for every plurality of estimation coefficients, and a selection unit that compares the pseudo high frequency subband power calculated by the pseudo high frequency subband power calculation unit and the high frequency subband power and selects any one of the plurality of estimation coefficients may be further provided. In the generation unit, the data to obtain the estimation coefficient selected by the selection unit may be generated, when the reuse of the estimation coefficient of the immediately previous frame is disabled.

In the encoding device, a high frequency encoding unit that encodes the data and generates high frequency encoding data may be further provided. In the multiplexing unit, the high frequency encoding data and the low frequency encoding data may be multiplexed and the output code string may be generated.

When a square sum of differences of the pseudo high frequency subband power and the high frequency subband power of the subbands of the high frequency side is a predetermined threshold value or less, the reuse of the estimation coefficient is enabled.

The reuse of the estimation coefficient is enabled according to a comparison result of an evaluation value showing a similarity degree of the pseudo high frequency subband power and the high frequency subband power, which is calculated on the basis of the pseudo high frequency subband power and the high frequency subband power of the subbands of the high frequency side, and a predetermined threshold value.

In the generation unit, one data may be generated for a processing target section including a plurality of frames of the input signal.

Information to specify a section including continuous frames in which the same estimation coefficient is selected, in the processing target section, can be included in the data.

One piece of information to specify the estimation coefficient can be included for the section, in the data.

An encoding method and a program according to the first aspect of the present technology include steps of performing band division of an input signal and generating high frequency subband signals of subbands of a high frequency side of the input signal, calculating pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance, when reuse of the estimation coefficient of the immediately previous frame is enabled in the frame of the processing target, on the basis of the pseudo high frequency subband power and the high frequency subband power obtained from the high frequency subband signal, generating data to obtain the reuse enabled estimation coefficient, encoding the low frequency signal and generating low frequency encoding data, and multiplexing the data and the low frequency encoding data and generating an output code string.

In the first aspect of the present technology, the band division of the input signal is performed and the high frequency subband signals of the subbands of the high frequency side of the input signal are generated. The pseudo high frequency subband power to be the estimation value of the high frequency subband power of the high frequency subband signal of the frame of the processing target is calculated on the basis of the feature amount obtained from the low frequency signal of the input signal and the estimation coefficient selected in the frame immediately before the frame of the processing target of the input signal among the plurality of estimation coefficients prepared in advance. When the reuse of the estimation coefficient of the immediately previous frame is enabled in the frame of the processing target, on the basis of the pseudo high frequency subband power and the high frequency subband power obtained from the high frequency subband signal, the data to obtain the reuse enabled estimation coefficient is generated. The low frequency signal is encoded and the low frequency encoding data is generated. The data and the low frequency encoding data are multiplexed and the output code string is generated.

A decoding device according to a second aspect of the present technology includes a demultiplexing unit that demultiplexes an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal, a low frequency decoding unit that decodes the low frequency encoding data and generates the low frequency signal, a high frequency signal generating unit that generates a high frequency signal, on the basis of the estimation coefficient obtained from the data and the low frequency signal obtained by the decoding, and a synthesis unit that generates an output signal, on the basis of the high frequency signal and the low frequency signal obtained by the decoding.

When it is determined that the reuse of the estimation coefficient of the immediately previous frame is disabled, the data included in the input code string can become the data to obtain the estimation coefficient selected from the plurality of estimation coefficients, by calculation of the estimation value of the high frequency subband power for every plurality of estimation coefficients and comparison of the calculated estimation value and the high frequency subband power.

In the decoding device, a data decoding unit that decodes the data can be further provided.

When a square sum of differences of the estimation value and the high frequency subband power is a predetermined threshold value or less, it can be determined that the reuse of the estimation coefficient is enabled.

One data can be generated for a processing target section including a plurality of frames of the input signal.

Information to specify a section including continuous frames in which the same estimation coefficient is selected, in the processing target section, can be included in the data.

One piece of information to specify the estimation coefficient can be included for the section, in the data.

A decoding method and a program according to the second aspect of the present technology includes steps of, demultiplexing an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal, decoding the low frequency encoding data and generating the low frequency signal, generating a high frequency signal, on the basis of the estimation coefficient obtained from the data and the low frequency signal obtained by the decoding, and generating an output signal, on the basis of the high frequency signal and the low frequency signal obtained by the decoding.

In the second aspect of the present technology, an input code string is demultiplexed into the data to obtain an estimation coefficient and low frequency encoding data obtained by encoding a low frequency signal of an input signal, wherein the data to obtain the estimation coefficient is generated according to the determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal. The low frequency encoding data is decoded and the low frequency signal is generated. The high frequency signal is generated on the basis of the estimation coefficient obtained from the data and the low frequency signal obtained by the decoding. The output signal is generated on the basis of the high frequency signal and the low frequency signal obtained by the decoding.

Effects of the Invention

According to the first and second aspects of the present technology, audio of a high audio quality can be obtained with a smaller code amount.

MODES FOR CARRYING OUT THE INVENTION

Hereinafter, embodiments to which the present technology is applied will be described with reference to the drawings.

<Outline of Present Technology>

[With Respect to Encoding of Input Signal]

The present technology relates to encoding an input signal using an audio signal such as a music signal as the input signal.

Figure 1:
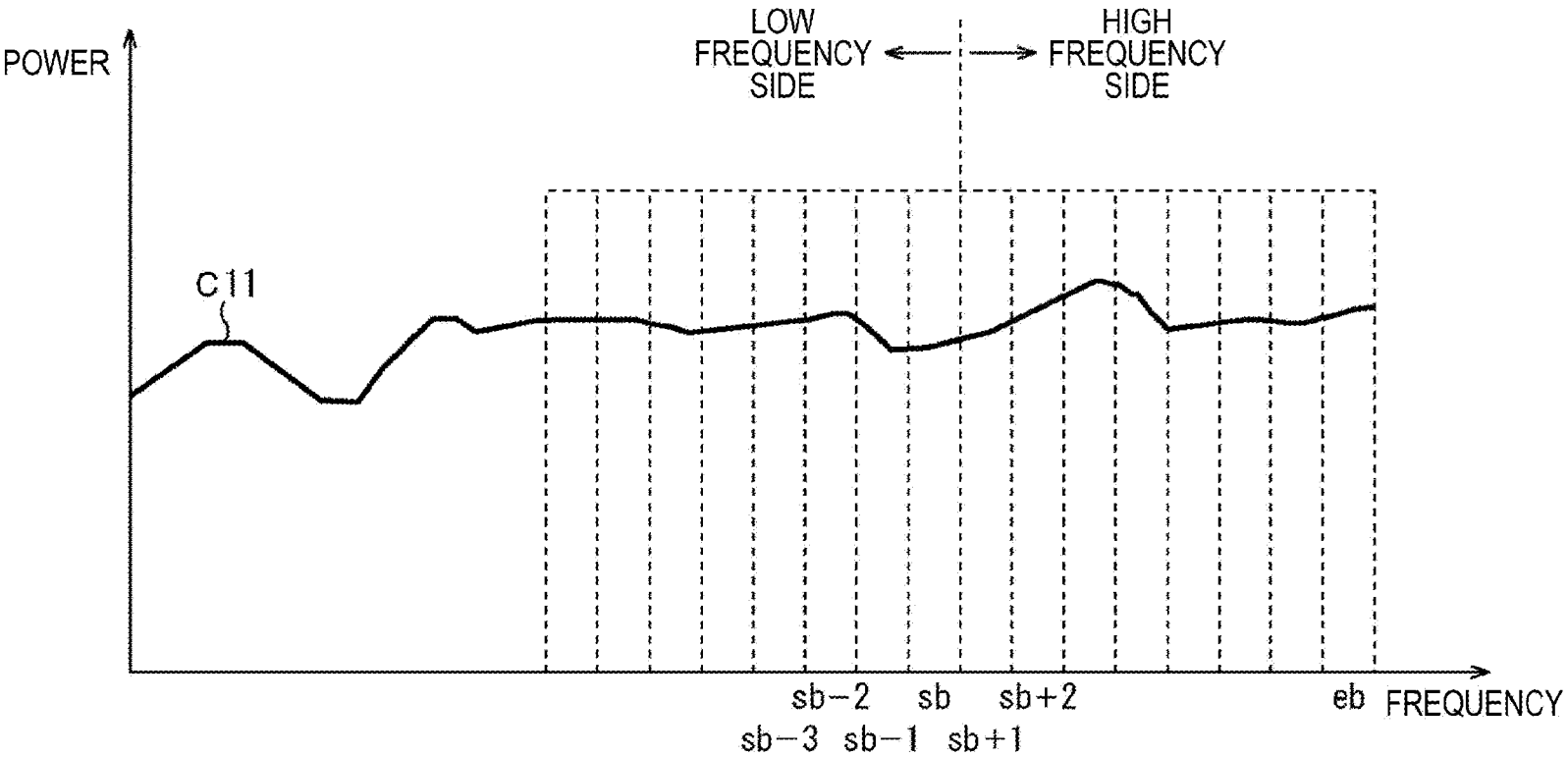
FIG. 1 is a diagram illustrating subbands of an input signal.

In an encoding device that encodes the input signal, when encoding is performed, the input signal is divided into subband signals of a plurality of frequency bands (hereinafter, referred to as subbands) having predetermined bandwidths, as illustrated in FIG. 1. In FIG. 1, a vertical axis shows power of each frequency of the input signal and a horizontal axis shows each frequency of the input signal. In addition, a curved line C11 shows power of each frequency component of the input signal and a dotted line of the vertical direction shows a boundary position of each subband.

If the input signal is divided into the subband signals of the individual subbands, components of a low frequency side equal to or lower than a predetermined frequency among frequency components of the input signal are encoded by a predetermined encoding method and low frequency decoding data is generated.

In an example of FIG. 1, subbands of frequencies equal or lower than a frequency of an upper limit of a subband sb in which an index to specify each subband is sb become low frequency components of the input signal and subbands of frequencies higher than the frequency of the upper limit of the subband sb become high frequency components of the input signal.

If low frequency encoding data is obtained, information to reproduce a subband signal of each subband of the high frequency components is generated on the basis of the low frequency components and the high frequency components of the input signal, this information is appropriately encoded by the predetermined encoding method, and high frequency encoding data is generated.

Specifically, the high frequency encoding data is generated from components of four subbands sb-3 to sb of a low frequency side arranged continuously in a frequency direction and having a highest frequency and components of (eb−(sb+1)+1) subbands sb+1 to eb of a high frequency side arranged continuously.

Here, the subband sb+1 is a subband of a high frequency that is adjacent to the subband sb and is positioned to be closest to the lowest frequency side and the subband eb is a subband having a highest frequency among the subbands sb+1 to eb arranged continuously.

The high frequency encoding data obtained by encoding of the high frequency component is information to generate a subband signal of a subband ib (however, sb+1≤ib≤eb) of the high frequency side by estimation. In the high frequency encoding data, a coefficient index to obtain an estimation coefficient used for estimation of each subband signal is included.

That is, in the estimation of the subband signal of the subband ib is estimated, an estimation coefficient including a coefficient $A_{ib}(kb)$ multiplied with power of a subband signal of a subband kb (however, sb−3≤kb≤sb) of the low frequency side and a coefficient $B_{ib}$ to be a constant term is used. The coefficient index that is included in the high frequency encoding data is information to obtain a set of estimation coefficients including the coefficients $A_{ib}(kb)$ and $B_{ib}$ of each subband ib, for example, information to specify the set of estimation coefficients.

If the low frequency encoding data and the high frequency encoding data are obtained in the above-described way, the low frequency encoding data and the high frequency encoding data are multiplexed and become an output code string and the output code string is output.

As such, the coefficient index to obtain the estimation coefficient is included in the high frequency encoding data, so that a code amount of the high frequency encoding data can be greatly decreased, as compared with the case of including a scale factor to calculate the high frequency component or an amplitude adjustment coefficient for each frame.

Further, the decoding device that has received the supplied output code string decodes the low frequency encoding data to obtain a decoded low frequency signal including the subband signal of each subband of the low frequency side and generates the subband signal of each subband of the high frequency side from the decoded low frequency signal and the information obtained by decoding the high frequency encoding data by the estimation. In addition, the decoding device generates an output signal from a decoded high frequency signal including the subband signal of each subband of the high frequency side obtained by the estimation and the decoded low frequency signal. The output signal that is obtained in the above-described way is an audio signal that is obtained by decoding the encoded input signal.

[With Respect to Output Code String]

In encoding of the input signal, an appropriate estimation coefficient (coefficient index) is selected for a frame becoming a processing target, from a plurality of estimation coefficients prepared in advance, for each section of a predetermined time length of an input signal, that is, for each frame.

In the encoding device, information of a time when the coefficient index changes in a time direction and a value of the changed coefficient index are included in the high frequency encoding data without including the coefficient index of each frame in the high frequency encoding data as it is, so that a code amount is further decreased.

In particular, when the input signal is a stationary signal in which a variation of each frequency component in a time direction is small, the selected estimation coefficients, that is, the coefficient indexes equal to each other in the time direction are continuous frequently. Therefore, in order to decrease information amount of the time direction of the coefficient index included in the high frequency encoding data, encoding of the high frequency components of the input signal is performed while the variable length method and the fixed length method are switched.

[With Respect to Variable Length Method]

Hereinafter, encoding of the high frequency components using the variable length method and the fixed length direction will be described.

When the high frequency components are encoded, switching of the variable length method and the fixed length method is performed for each section of the predetermined frame length. For example, in the following description, it is assumed that the switching of the variable length method and the fixed length method is performed for every 16 frames and a section corresponding to the 16 frames of the input signal is also referred to as a processing target section. That is, in the encoding device, an output code string is output in a unit of the 16 frames to be the processing target section.

First, the variable length method will be described. In encoding of the high frequency components using the variable length method, data including a method flag, a coefficient index, section information, and number information is encoded and becomes high frequency encoding data.

The method flag is information showing a method to generate the high frequency encoding data, that is, information showing which of the variable length method and the fixed length method is selected when the high frequency components are encoded.

In addition, the section information is information showing a length of a section included in the processing target section and including continuous frames, that is, a section (hereinafter, also referred to as a continuous frame section) including frames in which the same coefficient indexes are selected. In addition, the number information is information showing the number of continuous frame sections included in the processing target section.

Figure 2:
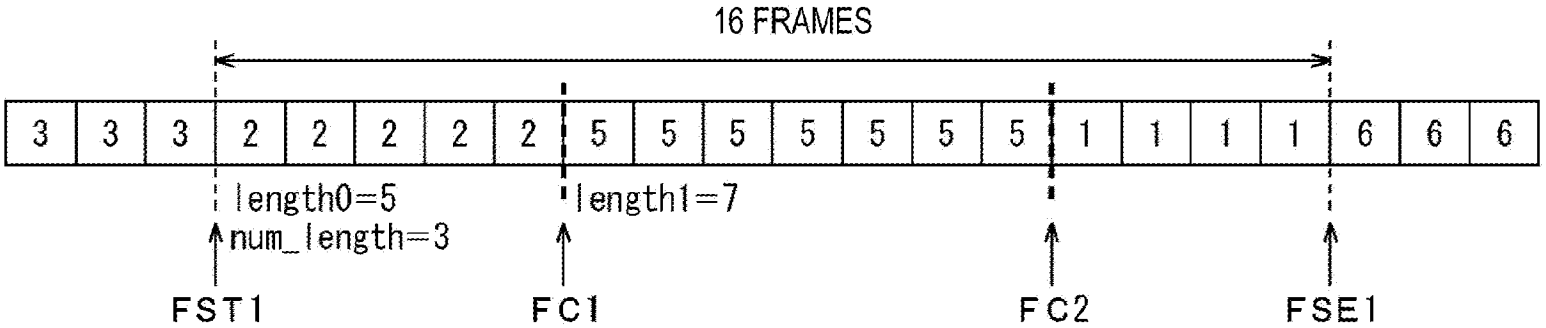
FIG. 2 is a diagram illustrating encoding of a high frequency component using a variable length method.

For example, in the variable length method, a section of 16 frames included between a position FST1 and a position FSE1 becomes one processing target section, as illustrated in FIG. 2. In FIG. 2, a horizontal direction shows a time and one rectangle shows one frame. In addition, a numerical value in the rectangle showing the frame shows a value of a coefficient index to specify an estimation coefficient selected for the corresponding frame.

In encoding of the high frequency components using the variable length method, first, the processing target section is divided into continuous frame sections including continuous frames in which the same coefficient indexes are selected. That is, a boundary position of adjacent frames in which different coefficient indexes are selected becomes a boundary position of each continuous frame section.

In this example, the processing target section is divided into three sections of a section from a position FST1 to a position FC1, a section from the position FC1 to a position FC2, and a section of the position FC2 to a position FSE1. For example, in the continuous frame section from the position FST1 to the position FC1, the same coefficient index "2" is selected in each frame.

In this way, if the processing target section is divided into the continuous frame sections, data including number information showing the number of continuous frame sections in the processing target section, a coefficient index selected in each continuous frame section, section information showing the length of each continuous frame section, and a method flag is generated.

Here, because the processing target section is divided into the three continuous frame sections, information showing "3" to be the number of continuous frame sections becomes the number information. In FIG. 2, the number information is represented by "num_length=3".

For example, section information of the first continuous frame section in the processing target section becomes a length "5" with a frame of the corresponding continuous frame section as a unit and is represented by "length0=5" in FIG. 2. Each section information can be specified for what number continuous frame section from a head of the processing target section each section information is section information of. In other words, information to specify a position of the continuous frame section in the processing target section is also included in the section information.

In this way, if the data including the number information, the coefficient index, the section information, and the method flag is generated for the processing target section, the data is encoded and becomes the high frequency encoding data. At this time, a coefficient index for each continuous frame section is included in the encoded data. In this case, when the same coefficient indexes are selected continuously in the plurality of frames, it is not necessary to transmit the coefficient index for each frame. Therefore, a data amount of the output code string to be transmitted can be decreased and encoding and decoding can be efficiently performed.

[With Respect to the Fixed Length Method]

Next, encoding of the high frequency components using the fixed length method will be described.

Figure 3:
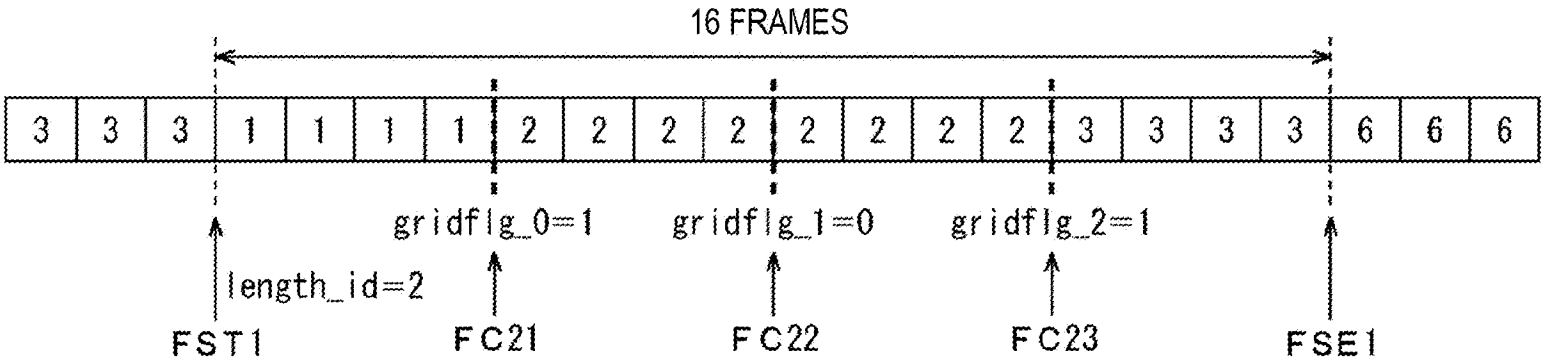
FIG. 3 is a diagram illustrating encoding of a high frequency component using a fixed length method.

In the fixed length method, the processing target section including the 16 frames is equally divided into sections (hereinafter, referred to as fixed length sections) including frames of the predetermined number, as illustrated in FIG. 3. In FIG. 3, a horizontal direction shows a time and one rectangle shows one frame. In addition, a numerical value in the rectangle showing the frame shows a value of a coefficient index to specify an estimation coefficient selected for the corresponding frame. In FIG. 3, portions corresponding to the portions in the case of FIG. 2 are denoted with the same reference numerals and description thereof is appropriately omitted.

In the fixed length method, the processing target section is divided into some fixed length sections. At this time, the length of the fixed length section is determined such that the coefficient indexes selected in the individual frames in the fixed length section are the same and the length of the fixed length section becomes longest.

In an example of FIG. 3, the length of the fixed length section (hereinafter, also simply referred to as a fixed length) becomes 4 frames and the processing target section is equally divided into four fixed length sections. That is, the processing target section is divided into a section from a position FST1 to a position FC21, a section from the position FC21 to a position FC22, a section from the position FC22 to a position FC3, and a section from the position FC23 to a position FSE1. The coefficient indexes in these fixed length sections become coefficient indexes "1", "2", "2 ", and "3", sequentially from the fixed length section of the head of the processing target section.

In this way, if the processing target section is divided into some fixed length sections, data including a fixed length index showing of the fixed length of the fixed length section in the processing target section, a coefficient index, a switching flag, and a method flag is generated.

Here, the switching flag is information showing whether the coefficient index changes at a boundary position of the fixed length sections, that is, in a final frame of a predetermined fixed length section and a frame of a head of a fixed length section subsequent to the corresponding fixed length section. For example, an i-th (i=0, 1, 2, . . . ) switching flag gridflg_i becomes "1" when the coefficient index changes at a boundary position of (i 1)-th and (i+2)-th fixed length sections from the head of the processing target section and becomes "0" when the coefficient index does not change.

In the example of FIG. 3, a switching flag gridflg_0 of the boundary position (position FC21) of the first fixed length section of the processing target section becomes "1", because a coefficient index "1" of the first fixed length section and a coefficient index "2" of the second fixed length section are different from each other. In addition, a switching flag gridflg_1 of the position FC22 becomes "0", because a coefficient index "2" of the second fixed length section and a coefficient index "2" of the third fixed length section are the same.

Further, the value of the fixed length index becomes a value that is acquired from the fixed length. Specifically, a fixed length index length_id becomes a value that satisfies a fixed length fixed length=$16/2^{length_id}$. In the example of FIG. 3, because the fixed length fixed length is 4, the fixed length index length_id becomes 2.

If the processing target section is divided into the fixed length sections and the data including the fixed length index, the coefficient index, the switching flag, and the method flag is generated, the data is encoded and becomes high frequency encoding data.

In the example of FIG. 3, data including switching flags gridflg_0=1, gridflg_1=0, and gridflg_2=1 between the position FC21 and the position FC23, a fixed length index length_id=2, coefficient indexes "1", "2", and "3" of the individual fixed length sections, and a method flag showing the fixed length method is encoded and becomes high frequency encoding data.

Here, the switching flag of the boundary position of each fixed length sections can be specified for what number boundary position from a head of the processing target section the switching flag is a switching flag of. In other words, information to specify the boundary position of the fixed length section in the processing target section is also included in the switching flag.

In addition, the individual coefficient indexes included in the high frequency encoding data are arranged in order in which the coefficient indexes are selected, that is, order in which the fixed length sections are arranged. In the example of FIG. 3, the coefficient indexes are arranged in the order of the coefficient indexes "1", "2", and "3" and are included in the encoding data.

In the example of FIG. 3, the coefficient indexes of the second and third fixed length sections from the head of the processing target section are "2". However, only one coefficient index "2" is included in the high frequency encoding data. When the coefficient indexes of the continuous fixed length sections are the same, that is, when the switching flag at the boundary positions of the continuous fixed length sections is 0, the same coefficient indexes of the number equal to the number of fixed length sections are not included in the high frequency encoding data and one coefficient index is included in the high frequency encoding data.

As such, if the high frequency encoding data is generated from the data including the fixed length index, the coefficient index, the switching flag, and the method flag, it is not necessary to transmit the coefficient index for each frame. Therefore, a data amount of the output code string to be transmitted can be decreased. Thereby, encoding and decoding can be efficiently performed.

[With Respect to Reuse of Estimation Coefficient]

In addition, when an estimation coefficient of a frame becoming a processing target, that is, a coefficient index is selected at the time of encoding the input signal, it is determined whether a coefficient index selected in a frame immediately before the frame of the processing target can be reused and the reuse is appropriately performed.

Figure 4:
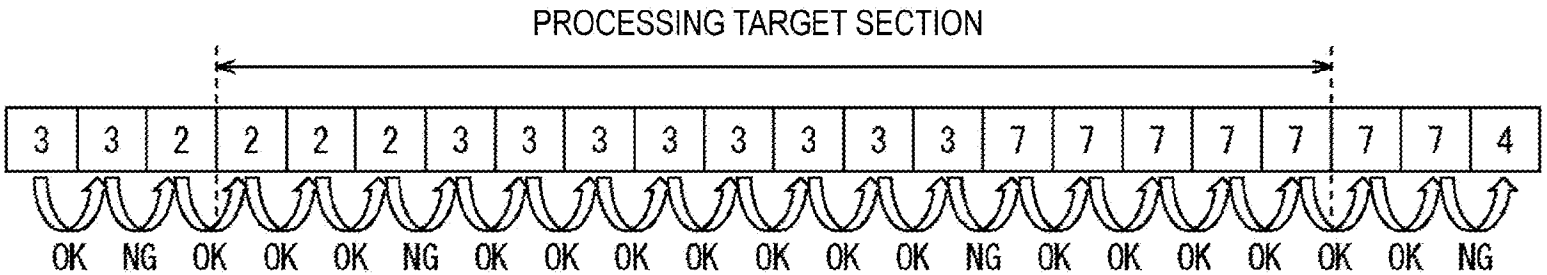
FIG. 4 is a diagram illustrating reuse of a coefficient index.

For example, as illustrated in FIG. 4, it is assumed that a coefficient index "2" is selected in a first frame in the processing target section. In FIG. 4, a horizontal direction shows a time and one rectangle shows one frame. In addition, a numerical value in the rectangle showing the frame shows a coefficient index to specify an estimation coefficient of the corresponding frame.

If the coefficient index "2" is selected in the first frame in the processing target section, a coefficient index of a next frame is selected. However, at this time, it is determined whether the reuse of the coefficient index "2" of the immediately previous frame is enabled.

For example, the estimation coefficient specified by the coefficient index "2" is used for a second frame of the processing target section becoming the processing target at a current point of time, a high frequency component of the second frame is estimated, and an estimation result and an actual high frequency component are compared with each other.

As a comparison result, when the high frequency component is obtained with sufficient estimation precision using the estimation coefficient specified by the coefficient index "2", it is determined that the reuse of the coefficient index of the estimation coefficient is enabled and the coefficient index of the second frame becomes "2". In an example of FIG. 4, the coefficient index of the second frame from the head of the processing target section becomes "2" that is equal to the coefficient index of the immediately previous frame.

Meanwhile, as the comparison result of the high frequency component obtained by the estimation and the actual high frequency component, when the high frequency component is not obtained with the sufficient estimation precision, a coefficient index of a most suitable estimation coefficient among a plurality of estimation coefficients prepared in advance is selected.

For example, in a fourth frame from the head in the processing target section, it is determined that reuse of a coefficient index of an immediately previous frame is disabled. For this reason, a coefficient index "3" that is different from a coefficient index "2" of a third frame is selected.

As such, in the case in which the estimation of the high frequency component is performed using the estimation coefficient specified by the coefficient index of the immediately previous frame for each frame, when the sufficient estimation precision is obtained, the coefficient index of the immediately previous frame is reused. By the reuse of the coefficient index, the coefficient index selected for each frame can be prevented from changing excessively in a time direction.

Thereby, because the continuous frame sections become longer, the number of coefficient indexes included in the high frequency encoding data of the processing target section can be further decreased and a data amount of the high frequency encoding data can be further decreased.

In addition, a characteristic such as the estimation error of the high frequency component is different according to the estimation coefficient. For this reason, if the change of the coefficient index in the time direction is excessively large, an unnatural time change of a frequency envelope not generated in an input signal before decoding may be generated in an audio signal obtained by the decoding and deterioration of an audio quality on acoustic feeling may be deteriorated. This deterioration of the audio quality is notable in a stationary audio signal in which the time change of the high frequency component is small.

However, as in the present technology, if the coefficient index is reused when the sufficient estimation precision is obtained, the coefficient index can be prevented from changing excessively. Therefore, the unnatural change of the high frequency component of the audio obtained by the decoding can be suppressed and the audio quality can be improved.

<First Embodiment>

[Example Structure of an Encoding Device]

Figure 5:
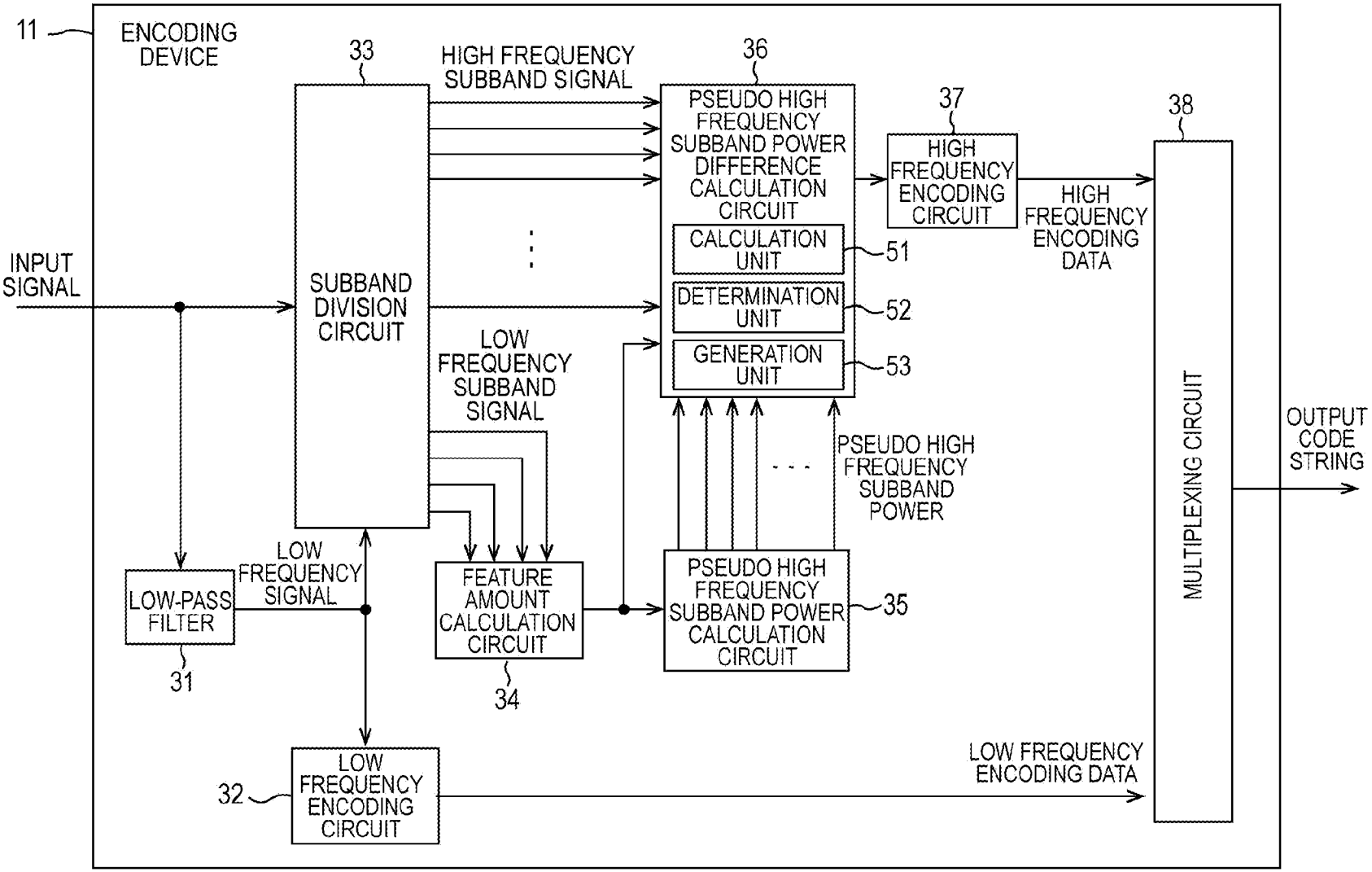
FIG. 5 is a diagram illustrating a configuration example of an encoding device to which the present technology is applied.

Next, specific embodiments of the technology for encoding the input signal described above will be described. First, a configuration of the encoding device that encodes an input signal will be described. FIG. 5 is a diagram illustrating a configuration example of the encoding device.

An encoding device 11 includes a low-pass filter 31, a low frequency encoding circuit 32, a subband division circuit 33, a feature amount calculation circuit 34, a pseudo high frequency subband power calculation circuit 35, a pseudo high frequency subband power difference calculation circuit 36, a high frequency encoding circuit 37, and a multiplexing circuit 38. In the encoding device 11, an input signal of an encoding target is supplied to the low-pass filter 31 and the subband division circuit 33.

The low-pass filter 31 filters the supplied input signal with a predetermined cutoff frequency and supplies a signal of a frequency lower than the cutoff frequency (hereinafter, referred to as a low frequency signal) obtained as a result thereof to the low frequency encoding circuit 32 and the subband division circuit 33.

The low frequency encoding circuit 32 encodes the low frequency signal supplied from the low-pass filter 31 and supplies low frequency encoding data obtained as a result thereof to the multiplexing circuit 38.

The subband division circuit 33 equally divides the low frequency signal supplied from the low-pass filter 31 into subband signals of a plurality of subbands (hereinafter, also referred to as low frequency subband signals) and supplies the obtained low frequency subband signals to the feature amount calculation circuit 34. The low frequency subband signals are signals of the individual subbands of the low frequency side of the input signal.

In addition, the subband division circuit 33 equally divides the supplied input signal into subband signals of a plurality of subbands and supplies a subband signal of each subband included in a predetermined band of the high frequency side among the obtained subband signals to the pseudo high frequency subband power difference calculation circuit 36. Hereinafter, the subband signal of each subband supplied from the subband division circuit 33 to the pseudo high frequency subband power difference calculation circuit 36 is also referred to as a high frequency subband signal.

The feature amount calculation circuit 34 calculates a feature amount on the basis of the low frequency subband signals supplied from the subband division circuit 33 and supplies the feature amount to the pseudo high frequency subband power calculation circuit 35 and the pseudo high frequency subband power difference calculation circuit 36.

The pseudo high frequency subband power calculation circuit 35 calculates an estimation value of power of a high frequency subband signal (hereinafter, also referred to as pseudo high frequency subband power), on the basis of the feature amount supplied from the feature amount calculation circuit 34, and supplies the estimation value to the pseudo high frequency subband power difference calculation circuit 36. In the pseudo high frequency subband power calculation circuit 35, a plurality of sets of estimation coefficients obtained by statistical learning are recorded and the pseudo high frequency subband power is calculated on the basis of the estimation coefficients and the feature amount.

The pseudo high frequency subband power difference calculation circuit 36 calculates power of the high frequency subband signal (hereinafter, also referred to as high frequency subband power) supplied from the subband division circuit 33 and calculates a square sum of a pseudo high frequency subband power difference showing a difference of the calculated power and the pseudo high frequency subband power.

The pseudo high frequency subband power difference calculation circuit 36 includes a calculation unit 51, a determination unit 52, and a generation unit 53.

The calculation unit 51 acquires an estimation coefficient specified by a coefficient index selected in a frame immediately before a frame of a processing target, from the pseudo high frequency subband power calculation circuit 35, and calculates the pseudo high frequency subband power, on the basis of the acquired estimation coefficient and the feature amount supplied from the feature amount calculation circuit 34. The pseudo high frequency subband power difference calculation circuit 36 calculates a square sum of the pseudo high frequency subband power difference, using any one of the pseudo high frequency subband power calculated by the calculation unit 51 and the pseudo high frequency subband power supplied from the pseudo high frequency subband power calculation circuit 35.

The determination unit 52 determines whether reuse of the coefficient index is enabled, on the basis of the square sum of the pseudo high frequency subband power difference calculated using the pseudo high frequency subband power calculated by the calculation unit 51. The pseudo high frequency subband power difference calculation circuit 36 selects a coefficient index for each frame of the input signal, on the basis of the square sum of the pseudo high frequency subband power difference and a determination result by the determination unit 52.

The generation unit 53 performs switching of the variable length method or the fixed length method, on the basis of a selection result of the coefficient index in each frame of the processing target section of the input signal, generates data to obtain the high frequency encoding data by the selected method, and supplies the data to the high frequency encoding circuit 37.

The high frequency encoding circuit 37 encodes the data supplied from the pseudo high frequency subband power difference calculation circuit 36 and supplies the high frequency encoding data obtained as a result thereof to the multiplexing circuit 38. The multiplexing circuit 38 multiplexes the low frequency encoding data supplied from the low frequency encoding circuit 32 and the high frequency encoding data supplied from the high frequency encoding circuit 37 and outputs multiplexed data as an output code string.

[Description of Encoding Process]

Figure 6:
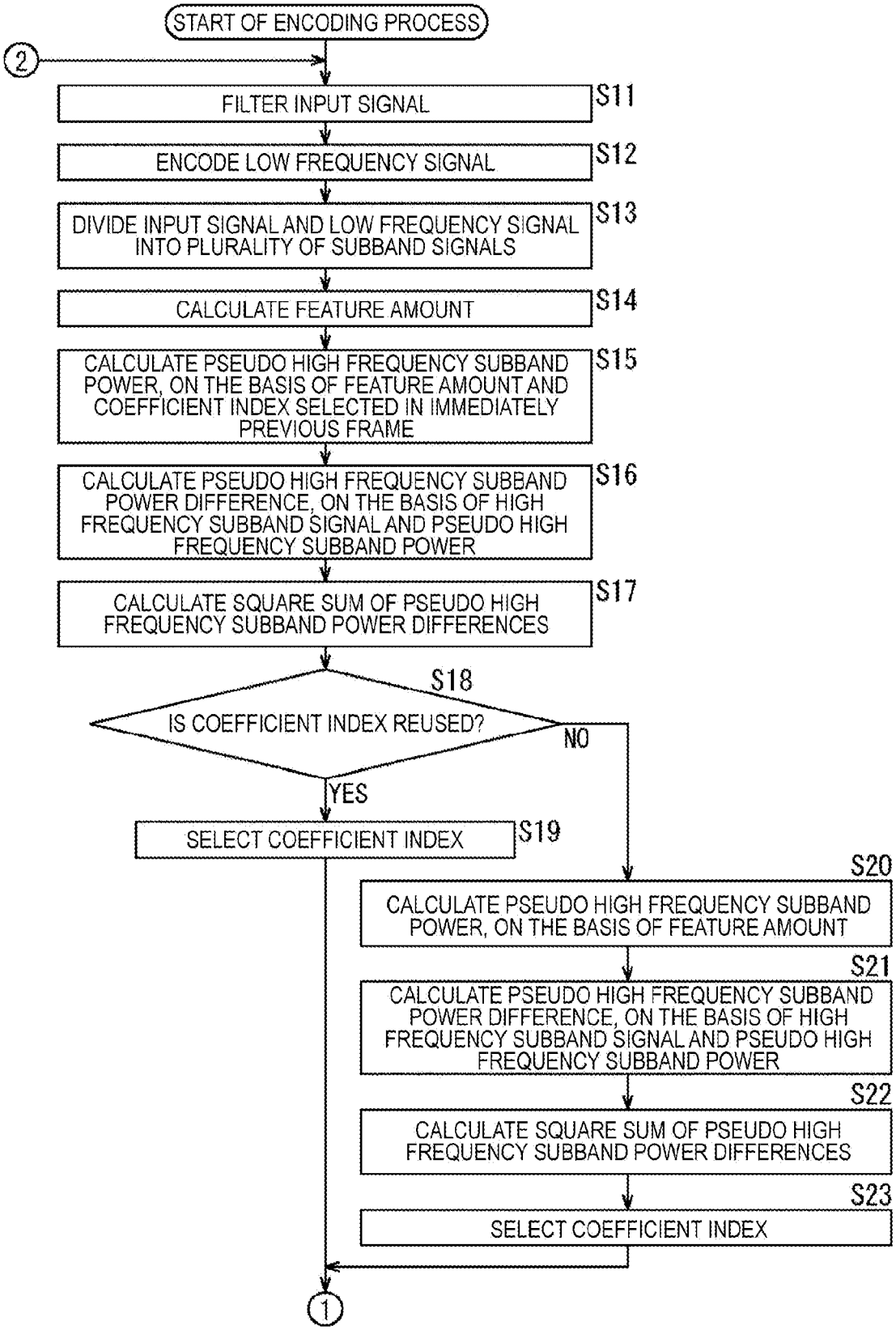
FIG. 6 is a flowchart illustrating an encoding process.
Figure 7:
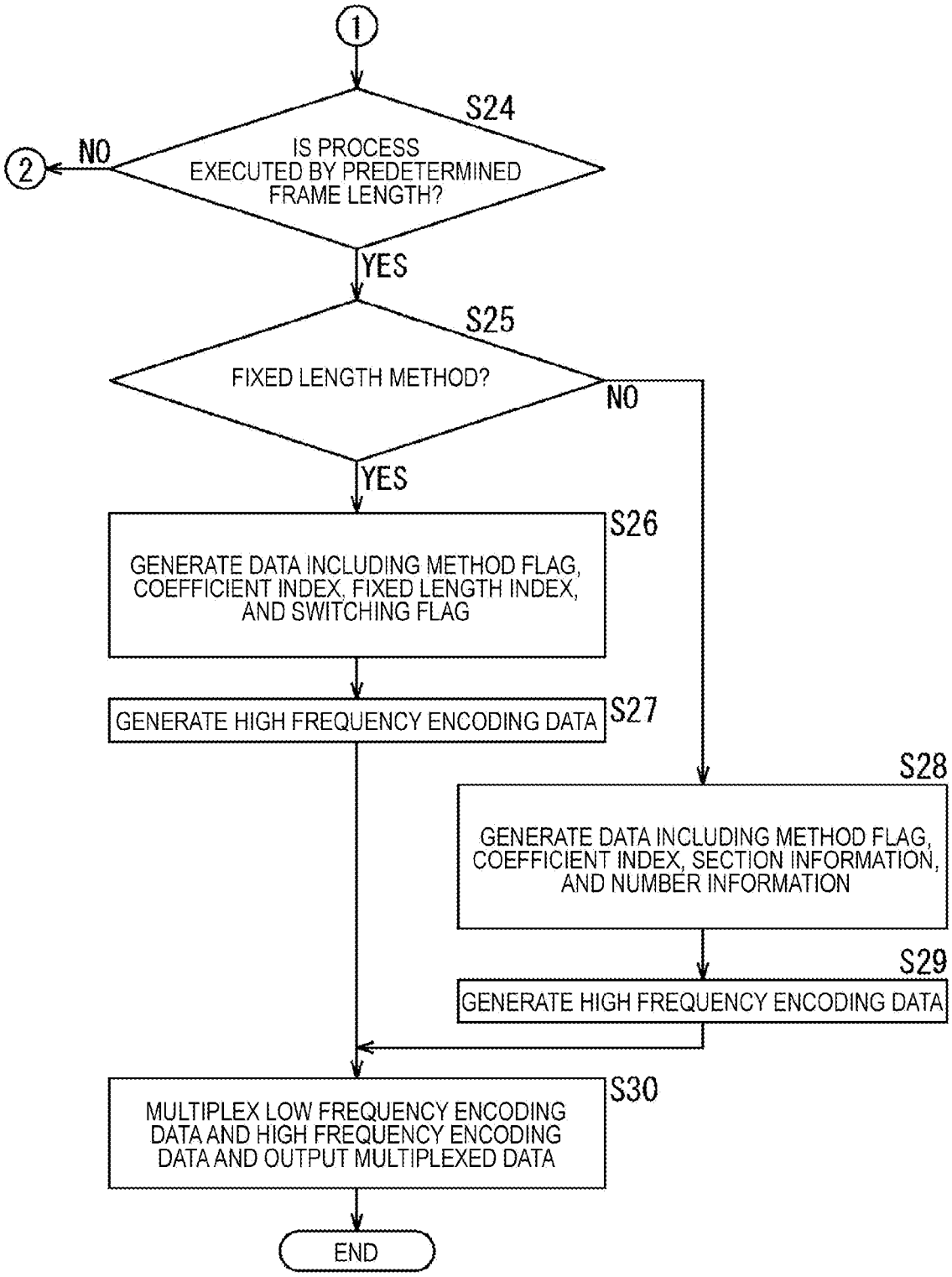
FIG. 7 is a flowchart illustrating an encoding process.

If an input signal is supplied and encoding of the input signal is instructed, the encoding device 11 illustrated in FIG. 5 executes the encoding process and outputs an output code string to the decoding device. Hereinafter, the encoding process by the encoding device 11 will be described with reference to flowcharts of FIGS. 6 and 7. The encoding process is executed for every predetermined frame number, that is, every processing target section.

In step S11, the low-pass filter 31 filters the supplied input signal of the frame of the processing target with a predetermined cutoff frequency and supplies a low frequency signal obtained as a result thereof to the low frequency encoding circuit 32 and the subband division circuit 33.

In step S12, the low frequency encoding circuit 32 encodes the low frequency signal supplied from the low-pass filter 31 and supplies low frequency encoding data obtained as a result thereof to the multiplexing circuit 38.

In step S13, the subband division circuit 33 equally divides the input signal and the low frequency signal into a plurality of subband signals having predetermined bandwidths.

That is, the subband division circuit 33 divides the supplied input signal into subband signals of individual subbands and supplies obtained subband signals of subbands sb+1 to eb of a high frequency side to the pseudo high frequency subband power difference calculation circuit 36.

In addition, the subband division circuit 33 divides the low frequency signal supplied from the low-pass filter 31 into subband signals of individual subbands and supplies obtained subband signals of subbands sb−3 to sb of a low frequency side to the feature amount calculation circuit 34.

In step S14, the feature amount calculation circuit 34 calculates a feature amount on the basis of the low frequency subband signals supplied from the subband division circuit 33 and supplies the feature amount to the pseudo high frequency subband power calculation circuit 35 and the pseudo high frequency subband power difference calculation circuit 36.

For example, power of each low frequency subband signal is calculated as the feature amount. Hereinafter, the power of the low frequency subband signal is also referred to as low frequency subband power in particular. In addition, the power of the subband signal of each subband such as the low frequency subband signal or the high frequency subband signal is also referred to as subband power.

Specifically, the feature amount calculation circuit 34 computes a next expression (1) and calculates subband power power (ib, J) of a subband ib (however, sb−3≤ib≤sb) of a frame J of a processing target expressed by a decibel.

[Mathematical Formula 1]

$$\text{power}(ib, J) = 10\log_{10}\left\{\left(\sum_{n=J*FSIZE}^{(J+1)FSIZE-1} x(ib, n)^2\right) \Big/ FSIZE\right\} \quad (1)$$

$$(sb-3 \le ib \le sb)$$

In the expression (1), x(ib, n) shows a value of a subband signal of the subband ib (sample value of a sample) and n in x(ib, n) shows an index of a discrete time. In addition, FSIZE in the expression 1 shows the number of samples of a subband signal configuring one frame.

Therefore, the low frequency subband power power(ib, J) of the frame J is calculated by executing a logarithmic conversion for a square sum value of a sample value of each sample of a low frequency subband signal configuring the frame J. Hereinafter, description is continued on the assumption that the low frequency subband power is calculated as the feature amount in the feature amount calculation circuit 34.

In step S15, the calculation unit 51 calculates pseudo high frequency subband power, on the basis of the low frequency subband power corresponding to the feature amount supplied from the feature amount calculation circuit 34 and a coefficient index selected in a frame (J−1) immediately before the frame J becoming the processing target.

For example, the calculation unit 51 acquires a set of estimation coefficients specified by the coefficient index selected in the immediately previous frame (J−1), from the pseudo high frequency subband power calculation circuit 35.

In addition, the calculation unit 51 computes a next expression (2) from the acquired estimation coefficients and the low frequency subband power power(ib, J) and calculates pseudo high frequency subband power $\text{power}_{est}$(ib, J) (however, sb+1≤ib≤eb) of each subband of a high frequency side.

[Mathematical Formula 2]

$$power_{est}(ib, J) = \left(\sum_{kb=sb-3}^{sb} \{A_{ib}(kb) \times \text{power}(kb, J)\}\right) + B_{ib} \quad (2)$$

$$(sb+1 \le ib \le eb)$$

In the expression (2), a coefficient $A_{ib}$(kb) and a coefficient $B_{ib}$ show a set of estimation coefficients prepared for a subband ib of a high frequency side. That is, the coefficient $A_{ib}$(kb) is a coefficient multiplexed with low frequency subband power power(kb, J) of a subband kb (however, sb−3≤kb≤sb) and the coefficient $B_{ib}$ is a constant term used when subband power of the subband kb is linearly combined.

Therefore, the pseudo high frequency subband power $\text{power}_{est}$(ib, J) of the subband ib of the high frequency side is obtained by multiplying the low frequency subband power of each subband of the low frequency side with the coefficient $A_{ib}$(kb) for each subband and adding the coefficient $B_{ib}$ to a sum of the low frequency subband power multiplied with the coefficient.

In step S16, the pseudo high frequency subband power difference calculation circuit 36 calculates a pseudo high frequency subband power difference, on the basis of the high frequency subband signal supplied from the subband division circuit 33 and the pseudo high frequency subband power calculated by the calculation unit 51.

Specifically, the pseudo high frequency subband power difference calculation circuit 36 executes the same operation as the above-described expression (1) for the high frequency subband signal supplied from the subband division circuit 33 and calculates high frequency subband power power(ib, J) (however, sb+1≤ib≤eb) in the frame J.

In addition, the pseudo high frequency subband power difference calculation circuit 36 computes a next expression (3) and calculates a pseudo high frequency subband power difference $\text{power}_{diff}$(ib, J) to be a difference of the high frequency subband power power(ib, J) and the pseudo high frequency subband power $\text{power}_{est}$(ib, J).

[Mathematical Formula 3]

$$\text{power}_{diff}(ib,J)=\text{power}(ib,J)-\text{power}_{est}(ib,J)\ (sb+1 \le ib \le eb) \quad (3)$$

In step S17, the pseudo high frequency subband power difference calculation circuit 36 computes a next expression (4) using the pseudo high frequency subband power difference power acquired for each subband ib (however, sb+1≤ib≤eb) of the high frequency side and calculates a square sum of the pseudo high frequency subband power difference.

[Mathematical Formula 4]

$$E(J, id(J-1)) = \sum_{ib=sb+1}^{eb} \{power_{diff}(ib, J, id(J-1))\}^2 \quad (4)$$

In the expression (4), a difference square sum E(J, id(J−1)) shows a square sum of a pseudo high frequency subband power difference of the frame J acquired for the estimation coefficient specified by the coefficient index id(J−1) selected in the frame (J−1) immediately before the frame J of the processing target.

In addition, in the expression (4), $power_{diff}(ib, J, id(J-1))$ shows a pseudo high frequency subband power difference $power_{diff}(ib, J)$ of the subband ib of the high frequency side of the frame J acquired for the estimation coefficient specified by the coefficient index id(J−1).

The difference square sum E(J, id(J−1)) obtained in the above-described way shows a similarity degree of high frequency subband power of the frame J calculated from the actual high frequency subband signal and pseudo high frequency subband power calculated using the estimation coefficient specified by the coefficient index selected in the immediately previous frame (J−1).

That is, it shows an error of an estimation value of a true value of the high frequency subband power. Therefore, when the difference square sum E(J, id(J−1)) is small, a signal near to a high frequency component of an actual input signal is obtained by an operation using the estimation coefficient.

Therefore, when the difference square sum E(J, id(J−1)) calculated for the frame J is small to some extent, the high frequency component can be estimated with sufficient precision, even though the estimation coefficient selected in the immediately previous frame (J−1) is used in the frame J. That is, reuse of the estimation coefficient (coefficient index) of the immediately previous frame (J−1) is enabled.

Meanwhile, if the difference square sum E(J, id(J−1)) is large, an error of the high frequency component of the actual input signal and the high frequency component obtained by the estimation is large and deterioration of an audio quality on acoustic feeling may be generated at the time of decoding. Therefore, in this case, the reuse of the coefficient index is disabled.

In step S18, the determination unit 52 determines whether the coefficient index is reused, on the basis of the difference square sum E(J, id(J−1)) calculated by a process of step S17. For example, when the difference square sum E(J, id(J−1)) is a predetermined threshold value or less, it is determined that the coefficient index is reused. For example, the threshold value becomes a predetermined value such as "3".

When it is determined in step S18 that the reuse of the coefficient index is enabled, in step S19, the pseudo high frequency subband power difference calculation circuit 36 selects the coefficient index selected in the immediately previous frame (J−1) as the coefficient index of the frame J. That is, the coefficient index (estimation coefficient) is reused.

If the coefficient index of the frame J is selected, the process proceeds to step S24. The coefficient index of the frame J selected in step S19 is used as the coefficient index selected in the frame immediately before the frame of the processing target, in a process of step S15 executed for a next frame (J+1).

Meanwhile, when it is determined in step S18 that the coefficient index is not reused, in step S20, the pseudo high frequency subband power calculation circuit 35 calculates the pseudo high frequency subband power, on the basis of the feature amount supplied from the feature amount calculation circuit 34.

Specifically, the pseudo high frequency subband power calculation circuit 35 executes the operation of the above-described expression (2) for every estimation coefficient recorded in advance, calculate pseudo high frequency subband power $power_{est}(ib, J)$, and supplies the pseudo high frequency subband power to the pseudo high frequency subband power difference calculation circuit 36. For example, when a set of K estimation coefficients in which coefficient indexes are 1 to K (however, $2 \leq K$) is prepared in advance, pseudo high frequency subband power of each subband is calculated for the set of K estimation coefficients.

In step S21, the pseudo high frequency subband power difference calculation circuit 36 calculates a pseudo high frequency subband power difference, on the basis of the high frequency subband signal supplied from the subband division circuit 33 and the pseudo high frequency subband power supplied from the pseudo high frequency subband power calculation circuit 35. In step S22, the pseudo high frequency subband power difference calculation circuit 36 calculates a square sum of the pseudo high frequency subband power difference for each estimation coefficient.

In steps S21 and S22, the same processes as steps S16 and S17 described above are executed. Thereby, a square sum (difference square sum) of the pseudo high frequency subband power difference is calculated for each set of K estimation coefficients.

In step S23, the pseudo high frequency subband power difference calculation circuit 36 selects the coefficient index, which shows the estimation coefficient corresponding to the difference square sum having a minimum value among the difference square sums for each set of K estimation coefficients, as the coefficient index of the frame J.

Here, the estimation coefficient that is used in calculating the difference square sum having the minimum value is an estimation coefficient in which an error of the high frequency component of the actual input signal and the high frequency component obtained by the estimation using the estimation coefficient is minimized. As such, when the estimation coefficient (coefficient index) cannot be reused, the set of estimation coefficients most suitable for the frame of the processing target among the sets of estimation coefficients recorded in advance is selected. If the coefficient index is selected, the process proceeds to step S24.

In step S19 or S23, if the coefficient index for the frame J of the processing target is selected, in step S24, the pseudo high frequency subband power difference calculation circuit 36 determines whether a process is executed by a predetermined frame length. That is, it is determined whether the coefficient indexes are selected for all of frames configuring the processing target section.

When it is determined in step S24 that the process is not executed by the predetermined frame length, the process returns to step S11 and the above-described process is repeated. That is, the frame of the processing target section not becoming the processing target becomes a next processing target frame and a coefficient index of the corresponding frame is selected.

Meanwhile, when it is determined in step S24 that the process is executed by the predetermined frame length, the process proceeds to step S25.

In step S25, the generation unit 53 determines whether a method of generating high frequency encoding data is set as the fixed length method.

That is, the generation unit 53 compares code amounts of high frequency encoding data generated by the fixed length method and high frequency encoding data generated by the variable length method, on the basis of a selection result of the coefficient index of each frame in the processing target section. In addition, the generation unit 53 determines that method of generating high frequency encoding data is set as the fixed length method, when the code amount of the high frequency encoding data of the fixed length method is smaller than the code amount of the high frequency encoding data of the variable length method.

When it is determined in step S25 that method of generating high frequency encoding data is set as the fixed length method, the process proceeds to step S26. In step S26, the generation unit 53 generates data including a method flag showing that the fixed length method is selected, a fixed length index, a coefficient index, and a switching flag and supplies the data to the high frequency encoding circuit 37.

In the example of FIG. 3, the generation unit 53 sets the fixed length as 4 frames and divides the processing target section from the position FST1 to the position FSE1 into four fixed length sections. In addition, the generation unit 53 generates data including a fixed length index "2", coefficient indexes "1", "2", and "3", switching flags "1", "0 ", and "1", and a method flag.

In FIG. 3, both the coefficient indexes of the second and third fixed length sections from the head of the processing target section are "2". However, because these fixed length sections are continuously arranged, only one coefficient index "2" is included in the data output from the generation unit 53.

In step S27, the high frequency encoding circuit 37 encodes the data supplied from the generation unit 53 and including the method flag, the fixed length index, the coefficient index, and the switching flag and generates high frequency encoding data. For example, entropy encoding is performed for information of a part or all of the method flag, the fixed length index, the coefficient index, and the switching flag, when necessary.

The high frequency encoding circuit 37 supplies the generated high frequency encoding data to the multiplexing circuit 38. Then, the process proceeds to step S30.

Meanwhile, when it is determined in step S25 that the method of generating high frequency encoding data is not set as the fixed length method, that is, that the method of generating high frequency encoding data is set as the variable length method, the process proceeds to step S28. In step S28, the generation unit 53 generates data including a method flag showing that the variable length method is selected, a coefficient index, section information, and number information and supplies the data to the high frequency encoding circuit 37.

In the example of FIG. 2, the generation unit 53 divides the processing target section from the position FST1 to the position FSE1 into three continuous frame sections. In addition, the generation unit 53 generates data including a method flag showing that the variable length method is selected, number information "num_length=3" showing "3" to be the number of continuous frame sections, section information "length0=5" and "length1=7" showing lengths of the individual continuous frame sections, and coefficient indexes "2", "5", and "1" of these continuous frame sections.

The coefficient indexes of the individual continuous frame sections are associated with the section information and a coefficient index of a certain continuous frame section can be specified. In the example of FIG. 2, because the number of frames configuring a final continuous frame section of a processing target section can be specified from a head of the processing target section and section information of a next continuous frame section, section information is not generated for the final continuous frame section.

In step S29, the high frequency encoding circuit 37 encodes the data supplied from the generation unit 53 and including the method flag, the coefficient index, the section information, and the number information and generates high frequency encoding data.

For example, in step S29, entropy encoding is performed for information of a part or all of the method flag, the coefficient index, the section information, and the number information. The high frequency encoding data may be any information from which an optimal estimation coefficient is obtained. For example, the data including the method flag, the coefficient index, the section information, and the number information may become the high frequency encoding data as it is. Likewise, even in step S27 described above, data such as the coefficient index may become the high frequency encoding data as it is.

The high frequency encoding circuit 37 supplies the generated high frequency encoding data to the multiplexing circuit 38. Then, the process proceeds to step S30.

In step S27 or S29, if the high frequency encoding data is generated, in step S30, the multiplexing circuit 38 multiplexes the low frequency encoding data supplied from the low frequency encoding circuit 32 and the high frequency encoding data supplied from the high frequency encoding circuit 37. In addition, the multiplexing circuit 38 outputs an output code string obtained by the multiplexing and the encoding process ends.

In this way, when the coefficient index of each frame is selected, the encoding device 11 determines whether the coefficient index of the immediately previous frame can be reused and reuses the coefficient index according to a determination result. In addition, the encoding device 11 encodes data including the selected coefficient index and generates high frequency encoding data.

As such, the data including the coefficient index is encoded to generate the high frequency encoding data, so that a code amount of the high frequency encoding data can be decreased, as compared with the case in which data used for an estimation operation of a high frequency such as a scale factor is encoded.

Moreover, the coefficient index is reused when necessary, so that the coefficient index can be prevented from changing excessively in the time direction, the code amount of the high frequency encoding data can be further decreased, and an audio quality of audio obtained by decoding can be improved.

In addition, of the fixed length method and the variable length method, the method in which the code amount decreases is selected for each processing target section and the high frequency encoding data is generated, so that a code amount of an output code string can be decreased and encoding or decoding of audio can be efficiently performed.

The example of the case in which the difference square sum E(j, id(J−1)) is used to determine whether the reuse of the coefficient index is enabled has been described. However, any factor that shows a comparison result of the actual high frequency component and the high frequency component obtained by the estimation may be used.

For example, a difference of the high frequency subband power power(ib, J) and the pseudo high frequency subband power $power_{est}$(ib, J) is acquired for each subband ib (however, sb+1≤ib≤eb) of the high frequency side and the differences may be used for determining whether a residual error mean square value $Res_{std}$ to be a mean square value of the differences can be reused.

In addition, a residual error maximum value $Res_{max}$ to be a maximum value among absolute values of the differences of the high frequency subband power and the pseudo high frequency subband power of the individual subbands ib of the high frequency side or a residual error mean value $Res_{ave}$ to be an absolute value of a mean value of the differences of the high frequency subband power and the pseudo high frequency subband power of the individual subbands ib may be used.

In addition, an evaluation value Res obtained by performing weight addition (linear combination) of a predetermined weight for the residual error mean square value $Res_{std}$, the residual error maximum value $Res_{max}$, and the residual error mean value $Res_{ave}$ may be used for determining whether the reuse of the coefficient index is enabled. When the evaluation value Res increases, an error of the actual high frequency component and the high frequency component obtained by the estimation using the estimation coefficient decreases.

In this case, the pseudo high frequency subband power difference calculation circuit 36 calculates the evaluation value Res using the estimation coefficient specified by the coefficient index selected in the immediately previous frame (J−1) in the frame J of the processing target. In addition, the determination unit 52 compares the obtained evaluation value Res and the threshold value (for example, 10) and determines that the reuse of the coefficient index is enabled, when the evaluation value Res is the threshold value or less. In this case, the coefficient index of the frame (J−1) is also selected (adopted) as the coefficient index of the frame J.

[Example Structure of a Decoding Device]

Next, the decoding device that receives the output code string output from the encoding device 11 and decodes the output code string will be described.

Figure 8:
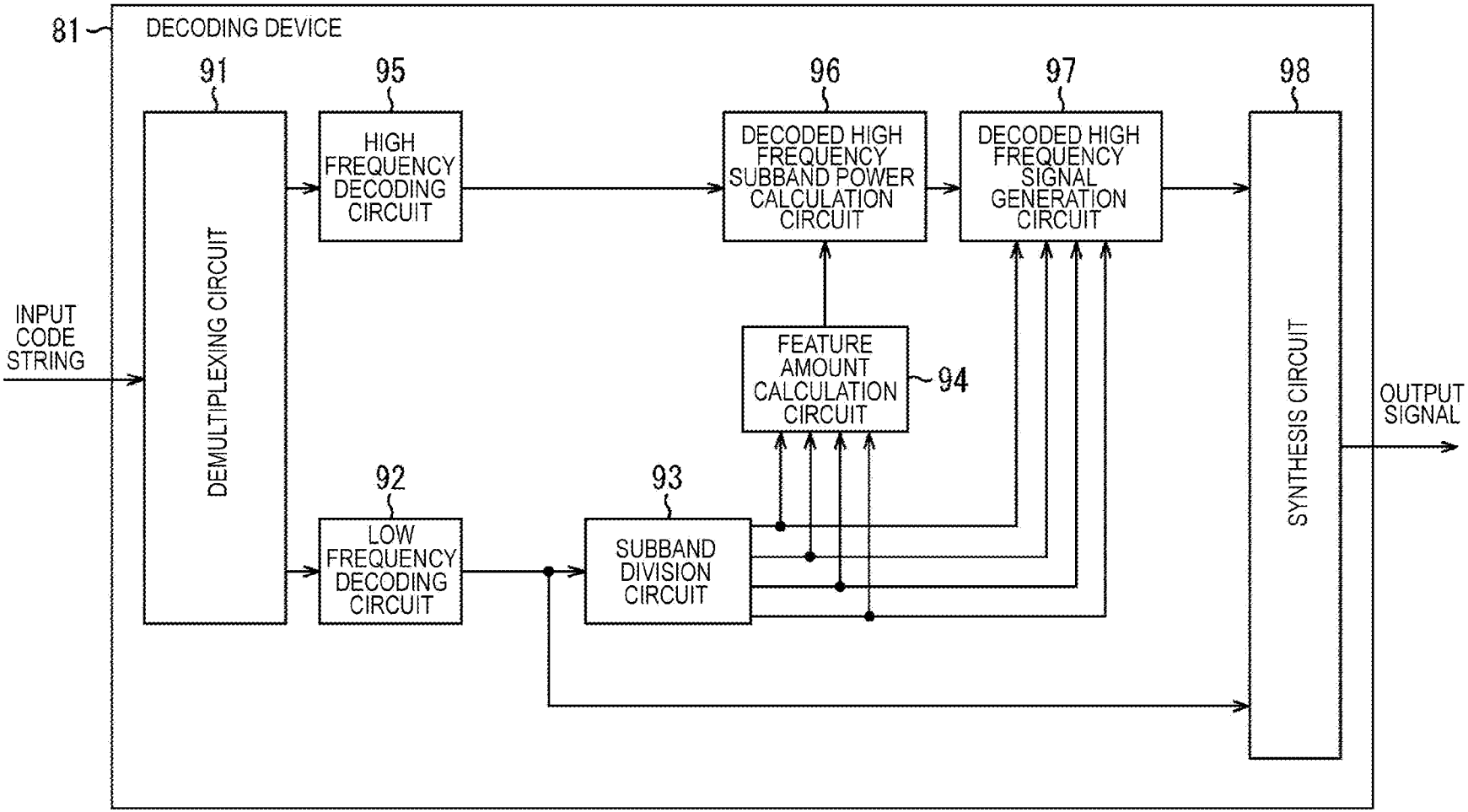
FIG. 8 is a diagram illustrating a configuration example of a decoding device.

For example, the decoding device is configured as illustrated in FIG. 8.

A decoding device 81 includes a demultiplexing circuit 91, a low frequency decoding circuit 92, a subband division circuit 93, a feature amount calculation circuit 94, a high frequency decoding circuit 95, a decoded high frequency subband power calculation circuit 96, a decoded high frequency signal generation circuit 97, and a synthesis circuit 98.

The demultiplexing circuit 91 uses the output code string received from the encoding device 11 as an input code string and demultiplexes the input code string into high frequency encoding data and low frequency encoding data. In addition, the demultiplexing circuit 91 supplies the low frequency encoding data obtained by the demultiplexing to the low frequency decoding circuit 92 and supplies the high frequency encoding data obtained by the demultiplexing to the high frequency decoding circuit 95.

The low frequency decoding circuit 92 decodes the low frequency encoding data supplied from the demultiplexing circuit 91 and supplies a decoded low frequency signal of the input signal obtained as a result thereof to the subband division circuit 93 and the synthesis circuit 98.

The subband division circuit 93 equally divides the decoded low frequency signal supplied from the low frequency decoding circuit 92 into a plurality of low frequency subband signals having predetermined bandwidths and supplies the obtained low frequency subband signals to the feature amount calculation circuit 94 and the decoded high frequency signal generation circuit 97.

The feature amount calculation circuit 94 calculates low frequency subband power of each subband of the low frequency side as a feature amount, on the basis of the low frequency subband signal supplied from the subband division circuit 93, and supplies the low frequency subband power to the decoded high frequency subband power calculation circuit 96.

The high frequency decoding circuit 95 decodes the high frequency encoding data supplied from the demultiplexing circuit 91 and supplies data obtained as a result thereof and an estimation coefficient specified by a coefficient index included in the data to the decoded high frequency subband power calculation circuit 96. That is, a plurality of coefficient indexes and estimation coefficients specified by the coefficient indexes are associated and recorded in the high frequency decoding circuit 95 in advance and the high frequency decoding circuit 95 outputs an estimation coefficient corresponding to the coefficient index included in the high frequency encoding data.

The decoded high frequency subband power calculation circuit 96 calculates decoded high frequency subband power to be an estimation value of subband power of each subband of a high frequency side for each frame, on the basis of the data and the estimation coefficient supplied from the high frequency decoding circuit 95 and the low frequency subband power supplied from the feature amount calculation circuit 94. For example, the same operation as the above-described expression (2) is executed and the decoded high frequency subband power is calculated. The decoded high frequency subband power calculation circuit 96 supplies the calculated decoded high frequency subband power of each subband to the decoded high frequency signal generation circuit 97.

The decoded high frequency signal generation circuit 97 generates a decoded high frequency signal on the basis of the low frequency subband signal supplied from the subband division circuit 93 and the decoded high frequency subband power supplied from the decoded high frequency subband power calculation circuit 96 and supplies the decoded high frequency signal to the synthesis circuit 98.

Specifically, the decoded high frequency signal generation circuit 97 calculates the low frequency subband power of the low frequency subband signal and performs amplitude modulation for the low frequency subband signal, according to a ratio of the decoded high frequency subband power and the low frequency subband power. In addition, the decoded high frequency signal generation circuit 97 performs frequency modulation for the amplitude modulated low frequency subband signal and generates a decoded high frequency subband signal of each subband of the high frequency side. The decoded high frequency subband signal that is obtained in the above-described way is an estimation value of a high frequency subband signal of each subband of the high frequency side of the input signal. The decoded high frequency signal generation circuit 97 supplies a decoded high frequency signal including the obtained decoded high frequency subband signal of each subband to the synthesis circuit 98.

The synthesis circuit 98 synthesizes the decoded low frequency signal supplied from the low frequency decoding circuit 92 and the decoded high frequency signal supplied from the decoded high frequency signal generation circuit 97 and outputs a synthesized signal as an output signal. This output signal is a signal obtained by decoding the encoded input signal and is a signal including a high frequency component and a low frequency component.

The above-described series of processes can be executed by hardware or can be executed by software. In the case in which the series of processes is executed by the software, a program configuring the software is installed from program recording media to a computer embedded into dedicated hardware or a general-purpose personal computer that can execute various functions by installing various programs.

Figure 9:
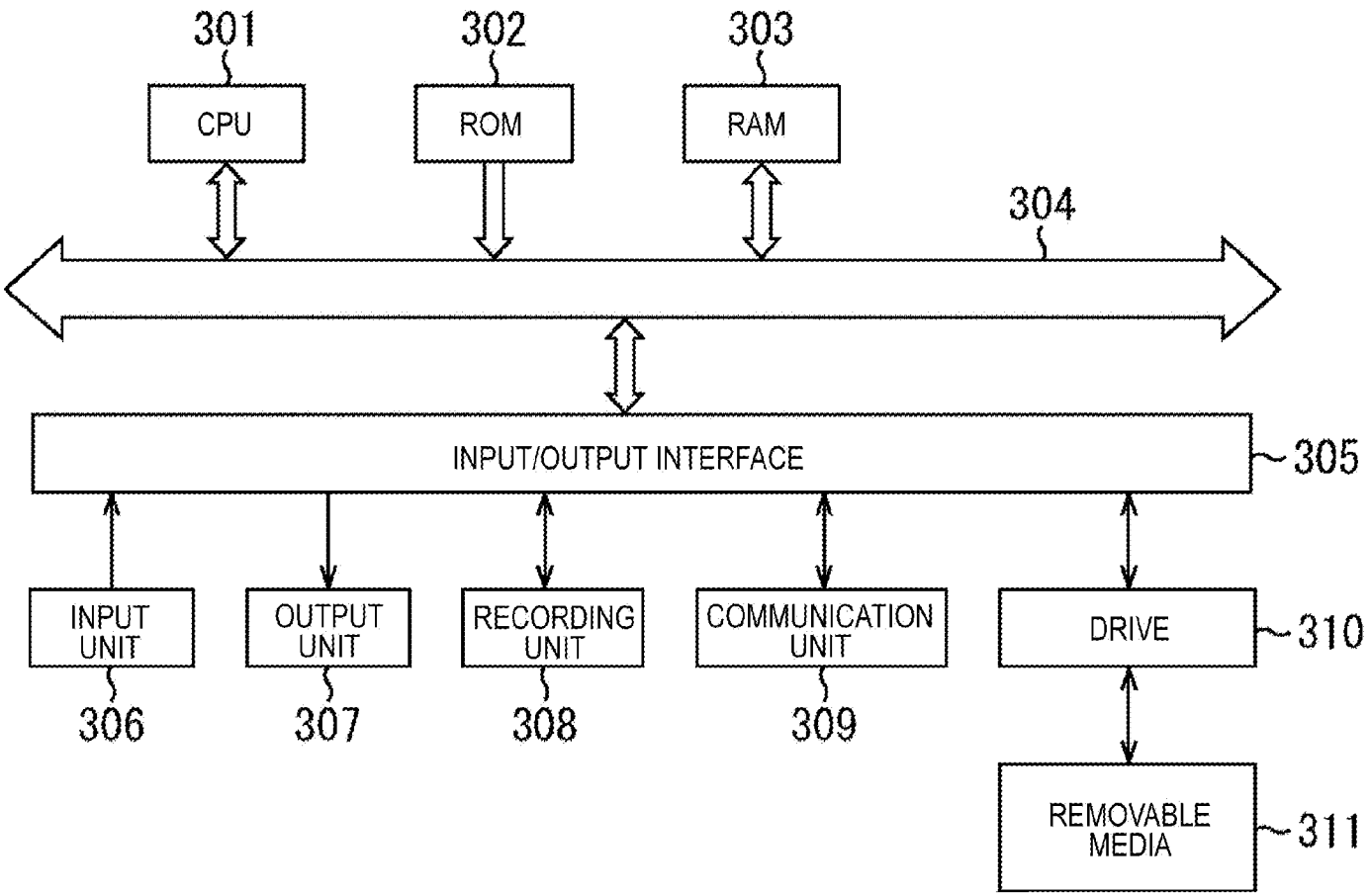
FIG. 9 is a diagram illustrating a configuration example of a computer.

FIG. 9 is a block diagram illustrating a configuration example of hardware of a computer that executes the above-described series of processes by programs.

In the computer, a CPU (Central Processing Unit) 301, a ROM (Read Only Memory) 302, and a RAM (Random Access Memory) 303 are connected to one another by a bus 304.

An input/output interface 305 is further connected to the bus 304. An input unit 306 including a keyboard, a mouse, a microphone, and the like, an output unit 307 including a display, a speaker, and the like, a recording unit 308 including a hard disk, a non-volatile memory, and the like, a communication unit 309 including a network interface and the like, and a drive 310 to drive removable media 311 such as a magnetic disk, an optical disk, a magneto-optical disk, or a semiconductor memory are connected to the input/output interface 305.

In the computer that is configured as described above, the CPU 301 loads programs recorded in the recording unit 308 to the RAM 303 through the input/output interface 305 and the bus 304 and executes the programs and the above-described series of processes is executed.

The programs to be executed by the computer (CPU 301) are recorded in the removable media 311 to be package media including magnetic disks (including flexible disks), optical disks (a CD-ROM (Compact Disc-Read Only Memory), a DVD (Digital Versatile Disc), and the like)), magneto-optical disks, or semiconductor memories and are provided or are provided through wired or wireless transmission media such as a local area network, the Internet, and digital satellite broadcasting.

The programs can be installed in the recording unit 308 through the input/output interface 305, by mounting the removable media 311 to the drive 310. In addition, the programs can be received by the communication unit 309 through the wired or wireless transmission media and can be installed in the recording unit 308. In addition, the programs can be installed in the ROM 302 or the recording unit 308 in advance.

The programs to be executed by the computer may be programs for performing operations in chronological order in accordance with the sequence described in this specification, or may be programs for performing operations in parallel or performing an operation when necessary, such as when there is a call.

Embodiments of the present technology are not limited to the above-described embodiments and various changes can be made without departing from the gist of the present technology.

Further, the present technology can take the following configurations.

[1]

An encoding device including:

a subband division unit that performs band division of an input signal and generates high frequency subband signals of subbands of a high frequency side of the input signal;

a calculation unit that calculates pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

a generation unit that, when reuse of the estimation coefficient of the immediately previous frame is enabled in the frame of the processing target, on the basis of the pseudo high frequency subband power and the high frequency subband power obtained from the high frequency subband signal, generates data to obtain the reuse enabled estimation coefficient;

a low frequency encoding unit that encodes the low frequency signal and generates low frequency encoding data; and a multiplexing unit that multiplexes the data and the low frequency encoding data and generates an output code string.

[2]

The encoding device according to [1], further including:

a pseudo high frequency subband power calculation unit that calculates the pseudo high frequency subband power on the basis of the feature amount and the estimation coefficients, for every plurality of estimation coefficients; and a selection unit that compares the pseudo high frequency subband power calculated by the pseudo high frequency subband power calculation unit and the high frequency subband power and selects any one of the plurality of estimation coefficients, wherein the generation unit generates the data to obtain the estimation coefficient selected by the selection unit, when the reuse of the estimation coefficient of the immediately previous frame is disabled.

[3]

The encoding device according to [1] or [2], further including:

a high frequency encoding unit that encodes the data and generates high frequency encoding data, wherein the multiplexing unit multiplexes the high frequency encoding data and the low frequency encoding data and generates the output code string.

[4]

The encoding device according to any one of [1] to [3], wherein, when a square sum of differences of the pseudo high frequency subband power and the high frequency subband power of the subbands of the high frequency side is a predetermined threshold value or less, the reuse of the estimation coefficient is enabled.

[5]

The encoding device according to any one of [1] to [3], wherein the reuse of the estimation coefficient is enabled according to a comparison result of an evaluation value showing a similarity degree of the pseudo high frequency subband power and the high frequency subband power, which is calculated on the basis of the pseudo high frequency subband power and the high frequency subband power of the subbands of the high frequency side, and a predetermined threshold value.

[6]

The encoding device according to any one of [1] to [5], wherein the generation unit generates one data for a processing target section including a plurality of frames of the input signal.

[7]

The encoding device according to [6], wherein information to specify a section including continuous frames in which the same estimation coefficient is selected, in the processing target section, is included in the data.

[8]

The encoding device according to [7], wherein one information to specify the estimation coefficient is included for the section, in the data.

[9]

An encoding method including steps of:

performing band division of an input signal and generating high frequency subband signals of subbands of a high frequency side of the input signal;

calculating pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

when reuse of the estimation coefficient of the immediately previous frame is enabled in the frame of the processing target, on the basis of the pseudo high frequency subband power and the high frequency subband power obtained from the high frequency subband signal, generating data to obtain the reuse enabled estimation coefficient;

encoding the low frequency signal and generating low frequency encoding data; and multiplexing the data and the low frequency encoding data and generating an output code string.

[10]

A program for causing a computer to execute a process including steps:

performing band division of an input signal and generating high frequency subband signals of subbands of a high frequency side of the input signal;

calculating pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

when reuse of the estimation coefficient of the immediately previous frame is enabled in the frame of the processing target, on the basis of the pseudo high frequency subband power and the high frequency subband power obtained from the high frequency subband signal, generating data to obtain the reuse enabled estimation coefficient;

encoding the low frequency signal and generating low frequency encoding data; and multiplexing the data and the low frequency encoding data and generating an output code string.

[11]

A decoding device including:

a demultiplexing unit that demultiplexes an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal;

a low frequency decoding unit that decodes the low frequency encoding data and generates the low frequency signal;

a high frequency signal generating unit that generates a high frequency signal, on the basis of the estimation coefficient obtained from the data and the low frequency signal obtained by the decoding; and a synthesis unit that generates an output signal, on the basis of the high frequency signal and the low frequency signal obtained by the decoding.

[12]

The decoding device according to [11], wherein, when it is determined that the reuse of the estimation coefficient of the immediately previous frame is disabled, the data included in the input code string is the data to obtain the estimation coefficient selected from the plurality of estimation coefficients, by calculation of the estimation value of the high frequency subband power for every plurality of estimation coefficients and comparison of the calculated estimation value and the high frequency subband power.

[13]

The decoding device according to [11] or [12], further including:

a data decoding unit that decodes the data.

[14]

The decoding device according to any one of [11] to [13], wherein, when a square sum of differences of the estimation value and the high frequency subband power is a predetermined threshold value or less, it is determined that the reuse of the estimation coefficient is enabled.

[15]

The decoding device according to any one of [11] to [14], wherein one data is generated for a processing target section including a plurality of frames of the input signal.

[16]

The decoding device according to [15], wherein information to specify a section including continuous frames in which the same estimation coefficient is selected, in the processing target section, is included in the data.

[17]

The decoding device according to [16], wherein one information to specify the estimation coefficient is included for the section, in the data.

[18]

A decoding method including steps of:

demultiplexing an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal;

decoding the low frequency encoding data and generating the low frequency signal;

generating a high frequency signal, on the basis of the estimation coefficient obtained from the data and the low frequency signal obtained by the decoding; and generating an output signal, on the basis of the high frequency signal and the low frequency signal obtained by the decoding.

[19]

A program for causing a computer to execute a process including steps of:

demultiplexing an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency sub-band power of the frame of the processing target, the estimation value being calculated based on a feature amount of the input signal, the estimation coefficient of the immediately previous frame and the high frequency sub-band power in the frame of the processing target of the input signal;

decoding the low frequency encoding data and generating the low frequency signal;

generating a high frequency signal, on the basis of the estimation coefficient obtained from the data and the low frequency signal obtained by the decoding; and generating an output signal, on the basis of the high frequency signal and the low frequency signal obtained by the decoding.

REFERENCE SIGNS LIST

11 Encoding device
32 Low frequency encoding circuit
33 Subband division circuit
34 Feature amount calculation circuit
35 Pseudo high frequency subband power calculation circuit
36 Pseudo high frequency subband power difference calculation circuit
37 High frequency encoding circuit
38 Multiplexing circuit
51 Calculation unit
52 Determination unit
53 Generation unit

The invention claimed is:

1. An encoding device including:

a subband division unit that performs band division of an input signal and generates high frequency subband signals of subbands of a high frequency side of the input signal;

a calculation unit that calculates pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

a generation unit that, when reuse of the estimation coefficient of the immediately previous frame is enabled in the frame of the processing target, on the basis of the pseudo high frequency subband power and the high frequency subband power obtained from the high frequency subband signal, generates data to obtain the reuse enabled estimation coefficient;

a low frequency encoding unit that encodes the low frequency signal and generates low frequency encoding data; and a multiplexing unit that multiplexes the data and the low frequency encoding data and generates an output code string.

2. The encoding device according to claim 1, further comprising:

a pseudo high frequency subband power calculation unit that calculates the pseudo high frequency subband power on the basis of the feature amount and the estimation coefficients, for every plurality of estimation coefficients; and a selection unit that compares the pseudo high frequency subband power calculated by the pseudo high frequency subband power calculation unit and the high frequency subband power and selects any one of the plurality of estimation coefficients, wherein the generation unit generates the data to obtain the estimation coefficient selected by the selection unit, when the reuse of the estimation coefficient of the immediately previous frame is disabled.

3. The encoding device according to claim 2, further comprising:

a high frequency encoding unit that encodes the data and generates high frequency encoding data, wherein the multiplexing unit multiplexes the high frequency encoding data and the low frequency encoding data and generates the output code string.

4. The encoding device according to claim 3, wherein, when a square sum of differences of the pseudo high frequency subband power and the high frequency subband power of the subbands of the high frequency side is a predetermined threshold value or less, the reuse of the estimation coefficient is enabled.

5. The encoding device according to claim 3, wherein the reuse of the estimation coefficient is enabled according to a comparison result of an evaluation value showing a similarity degree of the pseudo high frequency subband power and the high frequency subband power, which is calculated on the basis of the pseudo high frequency subband power and the high frequency subband power of the subbands of the high frequency side, and a predetermined threshold value.

6. The encoding device according to claim 3, wherein the generation unit generates one data for a processing target section including a plurality of frames of the input signal.

7. The encoding device according to claim 6, wherein information to specify a section including continuous frames in which the same estimation coefficient is selected, in the processing target section, is included in the data.

8. The encoding device according to claim 7, wherein one information to specify the estimation coefficient is included for the section, in the data.

9. An encoding method including:

performing band division of an input signal and generating high frequency subband signals of subbands of a high frequency side of the input signal;

calculating pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

when reuse of the estimation coefficient of the immediately previous frame is enabled in the frame of the processing target, on the basis of the pseudo high frequency subband power and the high frequency subband power obtained from the high frequency subband signal, generating data to obtain the reuse enabled estimation coefficient;

encoding the low frequency signal and generating low frequency encoding data; and multiplexing the data and the low frequency encoding data and generating an output code string.

10. A non-transitory computer-readable storage device encoded with computer-readable instructions that, when executed by a processing device, perform a process comprising:

performing band division of an input signal and generating high frequency subband signals of subbands of a high frequency side of the input signal;

calculating pseudo high frequency subband power to be an estimation value of high frequency subband power of the high frequency subband signal of a frame of a processing target, on the basis of a feature amount obtained from a low frequency signal of the input signal and an estimation coefficient selected in a frame immediately before the frame of the processing target of the input signal among a plurality of estimation coefficients prepared in advance;

when reuse of the estimation coefficient of the immediately previous frame is enabled in the frame of the processing target, on the basis of the pseudo high frequency subband power and the high frequency subband power obtained from the high frequency subband signal, generating data to obtain the reuse enabled estimation coefficient;

encoding the low frequency signal and generating low frequency encoding data; and multiplexing the data and the low frequency encoding data and generating an output code string.

11. A decoding device including:

a demultiplexing unit that demultiplexes an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency subband power of the frame of the processing target, the estimation value being calculated based on a feature amount of the input signal, the estimation coefficient of the immediately previous frame and the high frequency subband power in the frame of the processing target of the input signal;

a low frequency decoding unit that decodes the low frequency encoding data and generates the low frequency signal;

a high frequency signal generating unit that generates a high frequency signal, on the basis of the estimation coefficient obtained from the data and the low frequency signal obtained by the decoding; and a synthesis unit that generates an output signal, on the basis of the high frequency signal and the low frequency signal obtained by the decoding.

12. The decoding device according to claim 11, wherein, when it is determined that the reuse of the estimation coefficient of the immediately previous frame is disabled, the data included in the input code string is the data to obtain the estimation coefficient selected from the plurality of estimation coefficients, by calculation of the estimation value of the high frequency subband power for every plurality of estimation coefficients and comparison of the calculated estimation value and the high frequency subband power.

13. The decoding device according to claim 11, further comprising:

a data decoding unit that decodes the data.

14. The decoding device according to claim 11, wherein, when a square sum of differences of the estimation value and the high frequency subband power is a predetermined threshold value or less, it is determined that the reuse of the estimation coefficient is enabled.

15. The decoding device according to claim 11, wherein one data is generated for a processing target section including a plurality of frames of the input signal.

16. The decoding device according to claim 15, wherein information to specify a section including continuous frames in which the same estimation coefficient is selected, in the processing target section, is included in the data.

17. The decoding device according to claim 16, wherein one information to specify the estimation coefficient is included for the section, in the data.

18. A decoding method including:

demultiplexing an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency subband power of the frame of the processing target, the estimation value being calculated based on a feature amount of the input signal, the estimation coefficient of the immediately previous frame and the high frequency subband power in the frame of the processing target of the input signal;

decoding the low frequency encoding data and generating the low frequency signal;

generating a high frequency signal, on the basis of the estimation coefficient obtained from the data and the low frequency signal obtained by the decoding; and generating an output signal, on the basis of the high frequency signal and the low frequency signal obtained by the decoding.

19. A non-transitory computer-readable storage device encoded with computer-readable instructions that, when executed by a processing device, perform a process comprising:

demultiplexing an input code string into data to obtain an estimation coefficient and low frequency encoding data obtained by encoding a low frequency signal of an input signal, wherein the data to obtain the estimation coefficient is generated according to a determination result whether reuse of the estimation coefficient selected in a frame immediately before the frame of the processing target among a plurality of estimation coefficients prepared in advance is enabled in the frame of the processing target on the basis of an estimation value of high frequency subband power of the frame of the processing target, the estimation value being calculated based on a feature amount of the input signal, the estimation coefficient of the immediately previous frame and the high frequency subband power in the frame of the processing target of the input signal;

decoding the low frequency encoding data and generating the low frequency signal;

generating a high frequency signal, on the basis of the estimation coefficient obtained from the data and the low frequency signal obtained by the decoding; and generating an output signal, on the basis of the high frequency signal and the low frequency signal obtained by the decoding.

* * * * *